US010566701B2

(12) United States Patent
Izadian

(10) Patent No.: US 10,566,701 B2
(45) Date of Patent: Feb. 18, 2020

(54) FOLDED RADIATION SLOTS FOR SHORT WALL WAVEGUIDE RADIATION

(71) Applicant: Waymo LLC, Mountain View, CA (US)

(72) Inventor: Jamal Izadian, San Jose, CA (US)

(73) Assignee: Waymo LLC, Mountain View, CA (US)

( * ) Notice: Subject to any disclaimer, the term of this patent is extended or adjusted under 35 U.S.C. 154(b) by 4 days.

(21) Appl. No.: 15/621,173

(22) Filed: Jun. 13, 2017

(65) Prior Publication Data

US 2017/0279203 A1 Sep. 28, 2017

Related U.S. Application Data

(63) Continuation of application No. 14/453,416, filed on Aug. 6, 2014, now Pat. No. 9,711,870.

(51) Int. Cl.
*H01Q 21/00* (2006.01)

(52) U.S. Cl.
CPC ..... *H01Q 21/005* (2013.01); *H01Q 21/0043* (2013.01)

(58) Field of Classification Search
CPC ..... H01Q 13/02; H01Q 13/10; H01Q 13/16
See application file for complete search history.

(56) References Cited

U.S. PATENT DOCUMENTS 3,696,433 A * 10/1972 Killion ..... H01Q 13/10 333/237
4,513,291 A * 4/1985 Drabowitch ..... H01Q 21/0043 343/771
5,311,200 A * 5/1994 Walker ..... H01Q 21/0043 333/248

* cited by examiner

*Primary Examiner* — Graham P Smith
*Assistant Examiner* — Jae K Kim
(74) *Attorney, Agent, or Firm* — McDonnell Boehnen Hulbert & Berghoff LLP

(57) ABSTRACT

An example folded radiation slot for short wall waveguide radiation is disclosed. In one aspect, the radiating structure includes a waveguide layer configured to propagate electromagnetic energy via a waveguide. The waveguide may have a height dimension and a width dimension. The radiating structure also includes a radiating layer coupled to the waveguide layer, such that the radiating layer is parallel to the height dimension of the waveguide. The radiating layer may include a radiating element. The radiating element may be a slot defined by an angular or curved path, and the radiating element may be coupled to the waveguide layer. The radiating element may have an effective length greater than the height dimension of waveguide, wherein the effective length is measured along the angular or curved path of the slot.

22 Claims, 7 Drawing Sheets

FOLDED RADIATION SLOTS FOR SHORT WALL WAVEGUIDE RADIATION

CROSS-REFERENCE TO RELATED APPLICATIONS

The present application is a continuation of U.S. patent application Ser. No. 14/453,416, filed on Aug. 6, 2014, the entire contents of which are herein incorporated by reference.

BACKGROUND

Unless otherwise indicated herein, the materials described in this section are not prior art to the claims in this application and are not admitted to be prior art by inclusion in this section.

Radio detection and ranging (RADAR) systems can be used to actively estimate distances to environmental features by emitting radio signals and detecting returning reflected signals. Distances to radio-reflective features can be determined according to the time delay between transmission and reception. The radar system can emit a signal that varies in frequency over time, such as a signal with a time-varying frequency ramp, and then relate the difference in frequency between the emitted signal and the reflected signal to a range estimate. Some systems may also estimate relative motion of reflective objects based on Doppler frequency shifts in the received reflected signals.

Directional antennas can be used for the transmission and/or reception of signals to associate each range estimate with a bearing. More generally, directional antennas can also be used to focus radiated energy on a given field of view of interest. Combining the measured distances and the directional information allows for the surrounding environment features to be mapped. The radar sensor can thus be used, for instance, by an autonomous vehicle control system to avoid obstacles indicated by the sensor information.

Some example automotive radar systems may be configured to operate at an electromagnetic wave frequency of 77 Giga-Hertz (GHz), which corresponds to a millimeter (mm) wave electromagnetic wave length (e.g., 3.9 mm for 77 GHz). These radar systems may use antennas that can focus the radiated energy into tight beams in order to enable the radar system to measure an environment with high accuracy, such as an environment around an autonomous vehicle. Such antennas may be compact (typically with rectangular form factors), efficient (i.e., with little of the 77 GHz energy lost to heat in the antenna or reflected back into the transmitter electronics), and low cost and easy to manufacture (i.e., radar systems with these antennas can be made in high volume).

SUMMARY

In a first aspect, the present application discloses embodiments that relate to a radiating structure. In one aspect, the radiating structure includes a waveguide layer configured to propagate electromagnetic energy via a waveguide. The waveguide may have a height dimension and a width dimension. The radiating structure also includes a radiating layer coupled to the waveguide layer. The radiating layer may be parallel to the height dimension of the waveguide layer. Additionally, the radiating layer may include a radiating element. The radiating element may be a slot defined by an angular or curved path. Further, the radiating element may be coupled to the waveguide layer. Yet further, the radiating element may have an effective length greater than the height dimension of the waveguide, wherein the effective length is measured along the angular or curved path of the slot.

In another aspect, the present application describes a method of radiating electromagnetic energy. The method may involve propagating electromagnetic energy via a waveguide in a waveguide layer. The waveguide may have both a height dimension and a width dimension. The method may also involve coupling the electromagnetic energy from the waveguide to a radiating element located in a radiating layer. The radiating layer may be coupled to the waveguide layer and the radiating layer may be parallel to the height dimension of the waveguide layer. Additionally, the radiating layer may include the radiating element. The radiating element may be a slot defined by an angular or curved path. Additionally, the radiating element may be coupled to the waveguide layer. Further, the radiating element may have an effective length greater than the height dimension of the waveguide. The effective length of the radiating element may be measured along the angular or curved path of the slot. The method also may include radiating the coupled electromagnetic energy with the radiating element.

In yet another aspect, the present application describes another radiating structure. The radiating structure may include a waveguide layer configured to propagate electromagnetic energy via a waveguide. The waveguide of the waveguide layer may have a height dimension and a width dimension. Additionally, the electromagnetic energy may have a wavelength. The radiating structure may also have a radiating layer coupled to the waveguide layer. The radiating layer may be parallel to the height dimension of the waveguide layer. Additionally, the radiating layer may include a linear array of radiating elements. The array includes a plurality of radiating elements. Each radiating element may include a slot defined by an angular or curved path. Further, each radiating element may be coupled to the waveguide layer. Yet further, each radiating element may have an effective length greater than the height dimension of the waveguide. The effective length of the radiating element may be measured along the angular or curved path of the slot. Still further, each radiating element may have a respective rotation and the respective rotation of each radiating element may be selected based on a desired taper profile. Furthermore, a spacing between adjacent radiating elements in the linear array may be approximately equal to half the wavelength of the electromagnetic energy.

In another aspect, the present application describes an apparatus of radiating electromagnetic energy. The apparatus may involve a means for propagating electromagnetic energy in a waveguide layer. The means for propagating electromagnetic energy may have both a height dimension and a width dimension. The apparatus may also involve a means for coupling the electromagnetic energy from the means for propagating electromagnetic energy to a means for radiating located in a radiating layer. The radiating layer may be coupled to the waveguide layer and the radiating layer may be parallel to the height of the waveguide layer. Additionally, the radiating layer may include the means for radiating. The means for radiating may be defined by an angular or curved path. Additionally, the means for radiating may be coupled to the waveguide layer. Further, the means for radiating may have an effective length greater than the height dimension of waveguide. The effective length of the means for radiating may be measured along the angular or curved path of the slot. The apparatus also may include radiating the coupled electromagnetic energy with the means for radiating.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
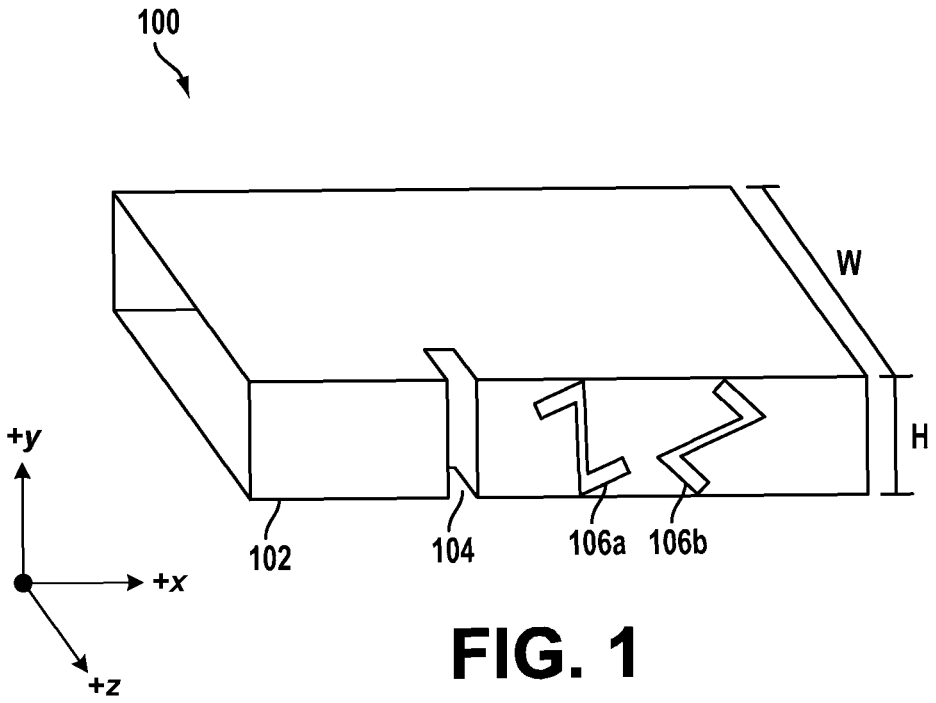
FIG. 1 illustrates an example of radiating slots on a waveguide.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following detailed description relates to an apparatus and method for a folded radiation slot for short wall waveguide radiation, such as an automotive, high-frequency (e.g., 77 GHz) radar antenna used for millimeter electromagnetic wave signaling. In practice, waveguide antennas may be fabricated in various ways. For instance, for printed waveguide transmission line (PWTL) antennas, a conductive adhesive thin film can be used to adhere the various layers of the PWTL antennas together. However, the performance of such an antenna may be less than optimal because the radiation efficiency and gain of the antenna is highly dependent on the conductivity of the conductive adhesive layer and its alignment and the time of the laminations.

For this reason, soldering (or metal to metal fusion) may provide better adhesion between metal layers, such as an aluminum sheet metal layer (with copper plating) adhered to copper foil/sheets. Sheet metals may be adhered to other sheet metals rather than foils, in other examples. Additionally, in some examples, before metal layers are adhered, various structures may be created in the respective metal layers. After adhesion, the various structures may form a radar unit, such as a radar unit for use in autonomous vehicles.

In one example a bottom layer may have a port feature. The port feature may enable electromagnetic energy (such as an electromagnetic wave) to enter the radar unit. The port feature may allow electromagnetic energy from a signal generation unit to be coupled into the radar unit for transmission into the environment around the radar unit (or around a vehicle to which the radar unit is coupled). Additionally, the port may enable electromagnetic energy within the radar unit to be coupled out of the radar unit. For example, when the radar unit receives electromagnetic energy, it may couple the electromagnetic energy out the port to processing electronics. Therefore, the port may function as a gateway between the radar unit and the signal generation and/or processing electronics that may operate the radar unit.

A middle layer may be coupled to both the bottom layer and the top layer. The middle layer may be referred to as a waveguide layer. The middle layer may have at least one waveguide in it. The waveguide may have a width that is measured with respect to a thickness of the middle layer (e.g. a maximum width of the waveguide in the middle layer may be equal to the thickness of the middle layer). Further, the height of the waveguide may be measured in the direction parallel to the plane in which the layers are adhered to each other. Additionally, in some examples, the width of the waveguide is larger than the height of the waveguide. The waveguides in the waveguide layer may perform several functions, such as routing, joining, and splitting of the electromagnetic energy.

In one example, the middle layer may receive electromagnetic energy from a port in the bottom layer. The waveguide of the middle layer may split the electromagnetic energy and route the electromagnetic energy to at least one radiating structure located in the top layer. In another example, the middle layer may receive electromagnetic energy from the at least one radiating structure in the top layer. The waveguides of the middle layer may join the electromagnetic energy and route the electromagnetic energy to the port located in the bottom layer.

The top layer may include at least one radiating structure. The radiating structure may be etched, cut, or otherwise located on sheet of metal that is adhered to the middle layer. The radiating structure may be configured to perform at least one of two functions. First, the radiating structure may be configured to radiate electromagnetic energy propagating inside the waveguide out into free space (i.e. the radiating structure converts the guided energy in the waveguide into radiated unguided energy propagating in free space). Second, the radiating structure may be configured to receive electromagnetic energy propagating in free space and route the received energy into the waveguide (i.e. the radiating structure converts the unguided energy from free space into guided energy propagating in a waveguide).

In some embodiments, the radiating structure may take the form of a radiating slot. The radiating slot may have a length dimension. The length dimension may correspond to a resonant frequency of operation for the slot. The resonant frequency of the slot may be equal to, or substantially close to, the frequency of the electromagnetic energy in the waveguide. For example, the length of the slot may be resonant at approximate half the wavelength of the electromagnetic energy in the waveguide. In some examples, the resonant length of the slot may be greater than the height of the waveguide. If the slot was longer than the waveguide, energy may not couple to the slot correctly, as the effective length of the slot is the length of the slot to which energy inside the waveguide can couple (i.e. the portion of the slot that is open to the waveguide). Thus, the electromagnetic energy may not radiate from the slot. However, in some examples, the slot may be shaped in a way that the total length of the slot is equal to the resonant length, but the slot still fits within a height of the waveguide. These shapes may be Z, S, 7, or other similar shapes (e.g. the total length of the shape is the total slot effective length, the bend of the shape allows a longer slot in a smaller space). Therefore, the slot may function like a slot that is longer than the height of the waveguide but still resonate at the desired radiation frequency.

In one example of fabrication of the waveguide unit, the structures located on each layer may be placed, cut, etched, or milled on each layer before the layers are adhered together. Thus, the location of the elements may be located fairly precisely on each layer when each is machined. When the bottom layer is adhered to the middle layer, the port may be located directly under a waveguide section. Thus, the entire port may be open to the waveguide in the middle layer. Additionally, the radiating elements of the top layer may be positioned in a way that the entire radiating element may be located directly above a waveguide section. Thus, the entire radiating element may be open to the waveguide in the middle layer.

FIGS. 1-4 illustrate example waveguides and radar systems in which example apparatuses for folded radiation slots for short wall waveguide radiation may be implemented.

Referring now to the figures, FIG. 1 illustrates an example of radiating slots (104, 106*a*, 106*b*) on a waveguide 102 in radar antenna unit 100. It should be understood that radar antenna unit 100 presents one possible configuration of radiating slots (104, 106*a*, 106*b*) on a waveguide 102.

It should also be understood that a given application of such an antenna may determine appropriate dimensions and sizes for both the radiating slots (104, 106*a*, 106*b*) and the waveguide 102. For instance, as discussed above, some example radar systems may be configured to operate at an electromagnetic wave frequency of 77 GHz, which corresponds to a 3.9 millimeter electromagnetic wave length. At this frequency, the channels, ports, etc. of an apparatus fabricated by way of method 100 may be of given dimensions appropriated for the 77 GHz frequency. Other example antennas and antenna applications are possible as well.

Waveguide 102 of radar antenna unit 100 has a height of H and a width of W. As shown in FIG. 1, the height of the waveguide extends in the Y direction and the width extends in the Z direction. Both the height and width of the waveguide may be chosen based on a frequency of operation for the waveguide 102. For example, when operating waveguide 102 at 77 GHz, the waveguide 102 may be constructed with a height H and width W to allow propagation of 77 GHz wave. An electromagnetic wave may propagate through the waveguide in the X direction. In some examples, the waveguide may have a standard size such as a WR-12 or WR-10. A WR-12 waveguide may support the propagation of electromagnetic waves between 60 GHz (5 mm wavelength) and 90 GHz (3.33 mm wavelength). Additionally, a WR-12 waveguide may have the internal dimensions of approximately 3.1 mm by 1.55 mm. A WR-10 waveguide may support the propagation of electromagnetic waves between 75 GHz (4 mm wavelength) and 110 GHz (2.727 mm wavelength). Additionally, a WR-12 waveguide may have the internal dimensions of approximately 2.54 mm by 1.27 mm. The dimensions of the WR-12 and the WR-10 waveguides are presented for examples. Other dimension are possible as well.

Waveguide 102 may be further configured to radiate the electromagnetic energy that is propagating through the waveguide. The radiating slots (104, 106*a*, 106*b*), as shown in FIG. 1, may be located on the surface of the waveguide 102. Additionally, as shown in FIG. 1, the radiating slots (104, 106*a*, 106*b*) may be located primarily on the side of the waveguide 102 with the height H dimension. Further, the radiating slots (104, 106*a*, 106*b*) may be configured to radiate electromagnetic energy in the Z direction.

The linear slot 104 may be a conventional waveguide radiating slot. A linear slot 104 may have a polarization in the same direction as the long dimension of the slot. The long dimension of the linear slot 104, measured in the Y direction, may be approximately one-half of the wavelength of the electromagnetic energy that is propagating through the waveguide. At 77 Ghz, the long dimension of the linear slot 104 may be approximately 1.95 mm to make the linear slot resonant. As shown in FIG. 1, the linear slot 104 may have a long dimension that is larger than the height H of the waveguide 102. Thus, the linear slot 104 may be too long to fit on just the side of the waveguide having the height H dimension. The linear slot 104 may continue on to the top and bottom of the waveguide 102. Additionally, a rotation of the linear slot 104 may be adjusted with respect to the orientation of the waveguide. By rotating the linear slot 104, an impedance of the linear slot 104 and a polarization and intensity of the radiation may be adjusted.

Additionally, the linear slot 104 has a width dimension that may be measured in the X direction. Generally, the width of the waveguide may be varied to adjust the bandwidth of the linear slot 104. In many embodiments, the width of the linear slot 104 may be approximately 10% of the wavelength of the electromagnetic energy that is propagating through the waveguide. At 77 Ghz, the width of the linear slot 104 may be approximately 0.39 mm. However, the width of the linear slot 104 may be made wider or narrower in various embodiments.

However, in some situations, it may not be practical or possible for a waveguide 102 to have a slot on any side other than the side of the waveguide having the height H dimension. For example, some manufacturing processes may create a waveguide structure in layers. The layers may cause only one side of the waveguide to be exposed to free space. When the layers are created, the top and bottom of the respective waveguide may not be exposed to free space. Thus, a radiating slot that extends to the top and bottom of the waveguide would not be fully exposed to free space, and therefore would not function correctly, in some configurations of the waveguide. Therefore, in some embodiments, folded slots 106*a* and 106*b* may be used to radiate electromagnetic energy from the inside the waveguide.

A waveguide may include slots of varied dimensions, such as folded slots 106*a* and 106*b*, in order to radiate electromagnetic energy. For example, folded slots 106*a* and 106*b* may be used on a waveguide in situations when a half-wavelength sized slot cannot fit on the side of the waveguide. The folded slots 106*a* and 106*b* each may have an associated length and width. The total length of the folded slots 106*a* and 106*b*, as measured through a curve or a bend in the folded slot, may be approximately equal to half the wavelength of the electromagnetic energy in the wave. Thus, at the same operating frequency, the folded slots 106*a* and 106*b* may have approximately the same overall length as the linear slot 104. As shown in FIG. 1, folded slots 106*a* and 106*b* are Z-Slots, as each is shaped like the letter Z. In various embodiments, other shapes may be used as well. For example, both S-Slots and 7-Slots may be used as well (where the slot is shaped like the letter or number it is named after).

The folded slots 106*a* and 106*b* may also each have a rotation. Similarly as described above, a rotation of the folded slots 106*a* and 106*b* may be adjusted with respect to the orientation of the waveguide. By rotating the folded slots 106*a* and 106*b*, an impedance of the folded slots 106*a* and 106*b* and a polarization of the radiation may be adjusted. The radiation intensity may also be varied by such a rotation, which can be used for amplitude tapers for arraying to lower Side Lobe Level (SLL). The SLL will be discussed further with respect to the array structure.

Figure 2:
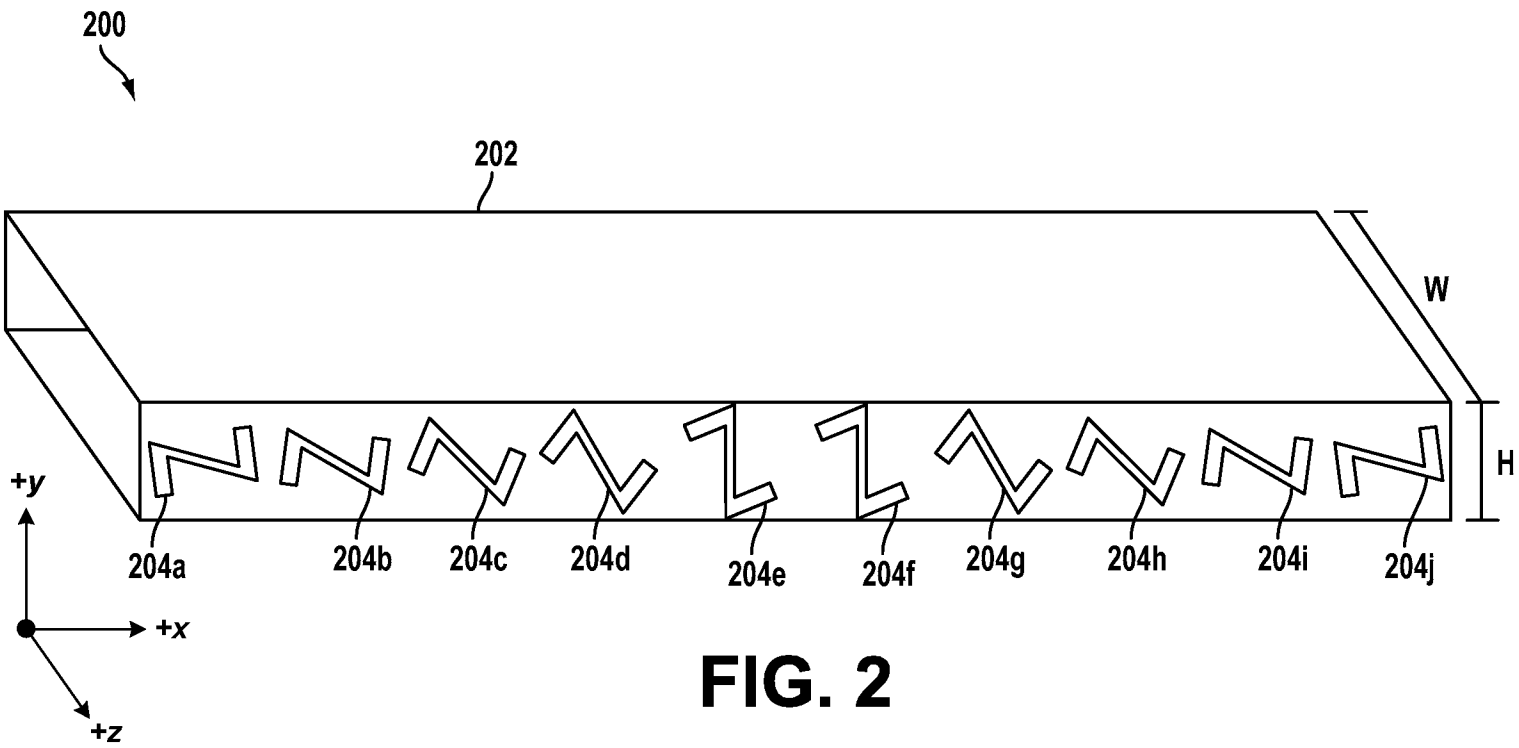
FIG. 2 illustrates an example waveguide with ten radiating Z-Slots.

FIG. 2 illustrates an example waveguide 202 with 10 radiating Z-Slots (204*a*-204*j*) in radar unit 200. As electromagnetic energy propagates down a waveguide 202, a portion of the electromagnetic energy may couple into one or more of the radiating Z-Slots (204*a*-204*j*) on the waveguide 202. Thus, each of the radiating Z-Slots (204*a*-204*j*) on the waveguide 202 may be configured to radiate an electromagnetic signal (in the Z direction). In some instances, each of the radiating Z-Slots (204*a*-204*j*) may have an associated impedance. The impedance for each respective radiating Z-Slot (204*a*-204*j*) may be a function of both the dimensions of the respective slot and the rotation of the respective slot. The impedance of each respective slot may determine a coupling coefficient for each respective radiating Z-Slot. The coupling coefficient determines a percentage of the electromagnetic energy propagating down a waveguide 202 that is radiated by the respective Z-Slot.

In some embodiments, the radiating Z-Slots (204*a*-204*j*) may be configured with rotations based on a taper profile. The taper profile may specify a given coupling coefficient for each radiating Z-Slots (204*a*-204*j*). Additionally, the taper profile may be chosen to radiate a beam with a desired beamwidth. For example, in one embodiment shown in FIG. 2, in order to obtain the taper profile, the radiating Z-Slots (204*a*-204*j*) may each have an associated rotation. The rotation of each radiating Z-Slot (204*a*-204*j*) may cause the impedance of each slot to be different, and thus cause the coupling coefficient for each radiating Z-Slot (204*a*-204*j*) to correspond to the taper profile. The taper profile of the radiating Z-Slots 204*a*-204*j* of the waveguide 202, as well as taper profiles of other radiating Z-Slots of other waveguides may control a beamwidth of an antenna array that includes a group of such waveguides. The taper profile may also be used to control SLL of the radiation. When an array radiates electromagnetic energy, the energy is generally radiated into a main beam and side lobes. Typically, sidelobes are an undesirable side effect from an array. Thus, the taper profile may be chosen to minimize or reduce the SLL (i.e. the amount of energy radiated in sidelobes) from the array.

Figure 3:
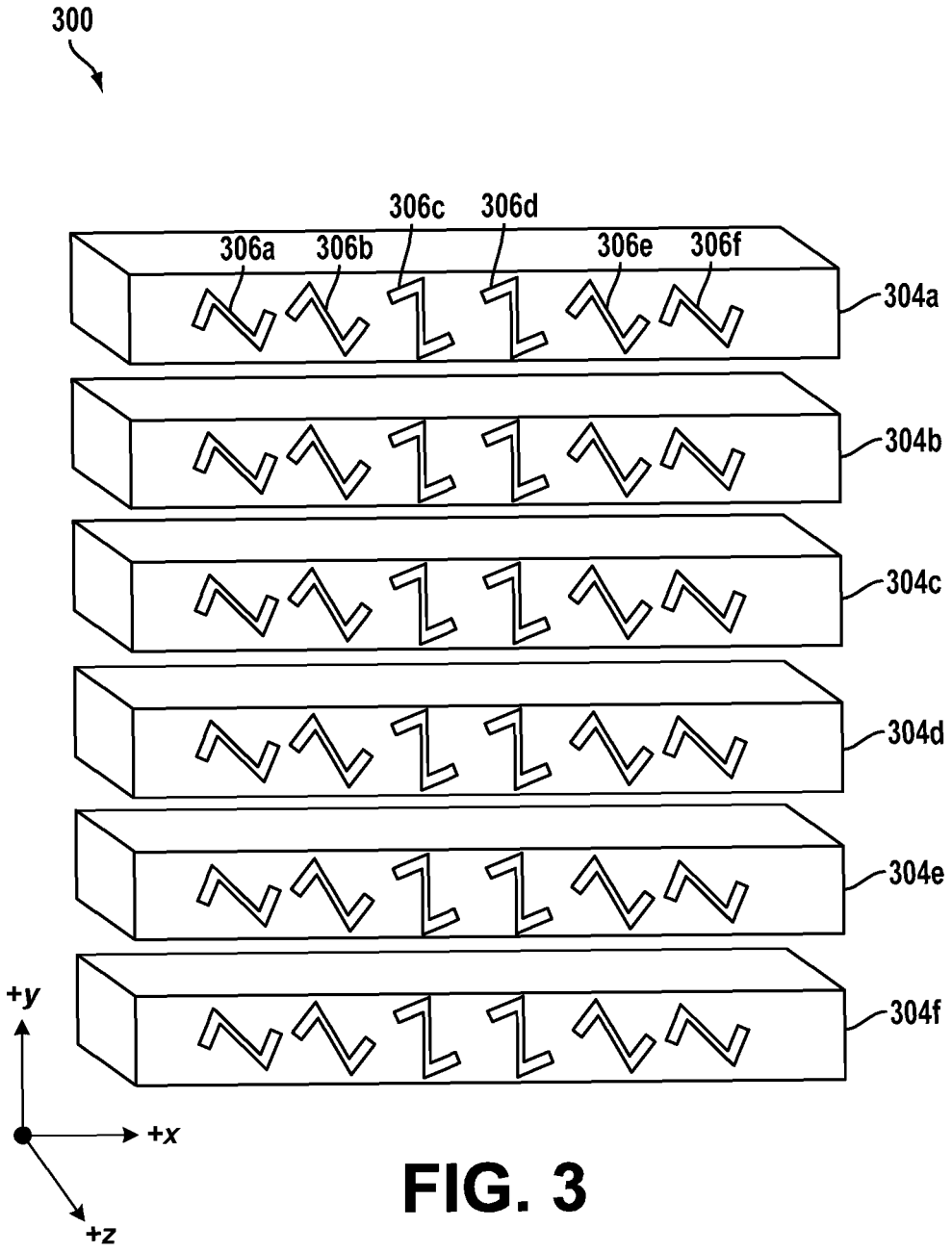
FIG. 3 illustrates an example radar system with six radiating waveguides.

FIG. 3 illustrates an example radar system 300 with six radiating waveguides 304*a*-304*f* Each of the six radiating waveguides 304*a*-304*f* may have radiating Z-Slots 306*a*-306*f*. Each of the six radiating waveguides 304*a*-304*f* may be similar to the waveguide 202 described with respect to FIG. 2. In some embodiments, a group of waveguides, each containing radiating slots, may be known as an antenna array. The configuration of the six radiating waveguides 304*a*-304*f* of the antenna array may be based on both a desired radiation pattern and a manufacturing process for the radar system 300. Two of the components of the radiation pattern of the radar system 300 include a beam width as well as a beam angle. For example, similar to as discussed with FIG. 2, a taper profile of the radiating Z-Slots 306*a*-306*f* of each of the radiating waveguides 304*a*-304*f* may control a beamwidth of the antenna array. A beamwidth of the radar system 300 may correspond to an angle with respect to the antenna plane (e.g. the X-Y plane) over which a majority of the radar system's radiated energy is directed.

Figure 4:
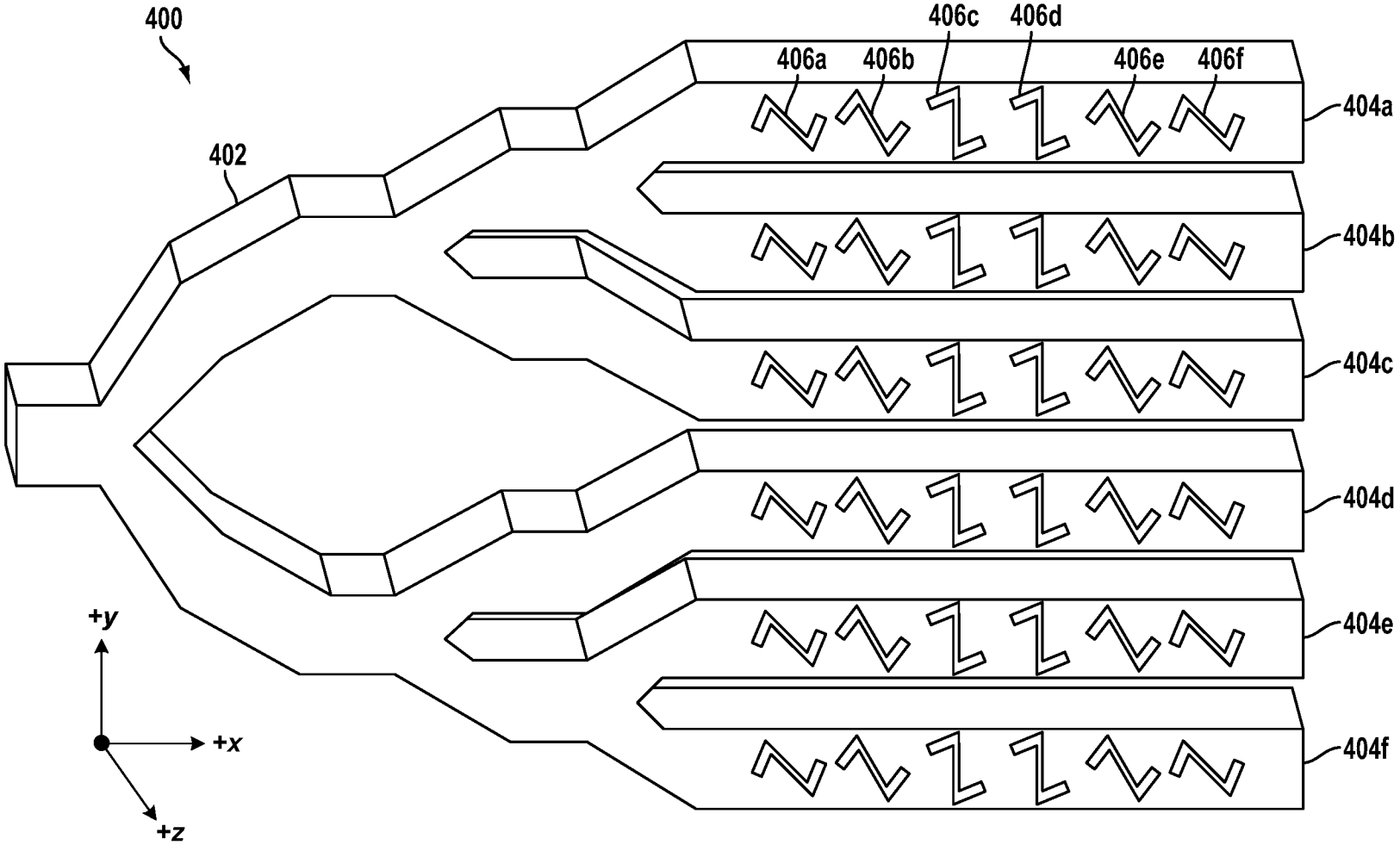
FIG. 4 illustrates an example radar system with six radiating waveguides and a waveguide feed system.

FIG. 4 illustrates an example radar system 400 with six radiating waveguides 404*a*-404*f* and a waveguide feed system 402. The six radiating waveguides 404*a*-404*f* may be similar to the six radiating waveguides 304*a*-304*f* of FIG. 3. In some embodiments, the waveguide feed system 402 may be configured to receive an electromagnetic signal at an input port and divide the electromagnetic signal between the six radiating waveguides 404*a*-404*f* Thus, the signal that each radiating Z-Slot 406*a*-406*f* of each of the radiating waveguides 404*a*-404*f* radiates may propagate in the X direction through the waveguide feed system. In various embodiments, the waveguide feed system 402 may have different shapes or configurations than that shown in FIG. 4. Based on the shape and configuration of the waveguide feed system 402 various parameters of the radiated signal may be adjusted. For example, a direction and a beamwidth of a radiated beam may be adjusted based on the shape and configuration of the waveguide feed system 402.

Figure 5:
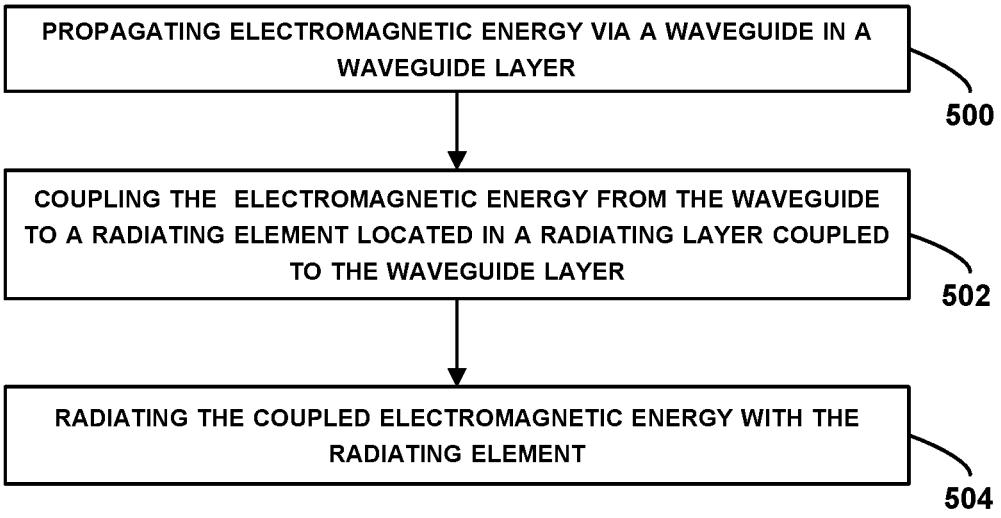
FIG. 5 is an example method for radiating electromagnetic energy with an example waveguide antenna.

FIG. 5 is an example method for radiating electromagnetic energy with an example waveguide antenna, such as a 77 GHz waveguide folded slot antenna configured to propagate millimeter electromagnetic waves. Although blocks 500-504 are illustrated in a sequential order, these blocks may also be performed in parallel, and/or in a different order than those described herein. Also, the various blocks may be combined into fewer blocks, divided into additional blocks, and/or removed based upon the desired implementation.

In some embodiments, some shapes and dimensions of a waveguide antenna may be highly convenient to manufacture, though other shapes, dimensions, and methods associated therewith known or not yet known may be implemented with equal or even greater convenience. Various shapes and dimensions of portions of the manufactured waveguide antenna, such as portions of waveguide channels formed in the antenna, including shapes and dimensions other than those described herein, are possible as well. Subsequent and/or intermediate blocks may be involved as well in other embodiments.

Figure 6:
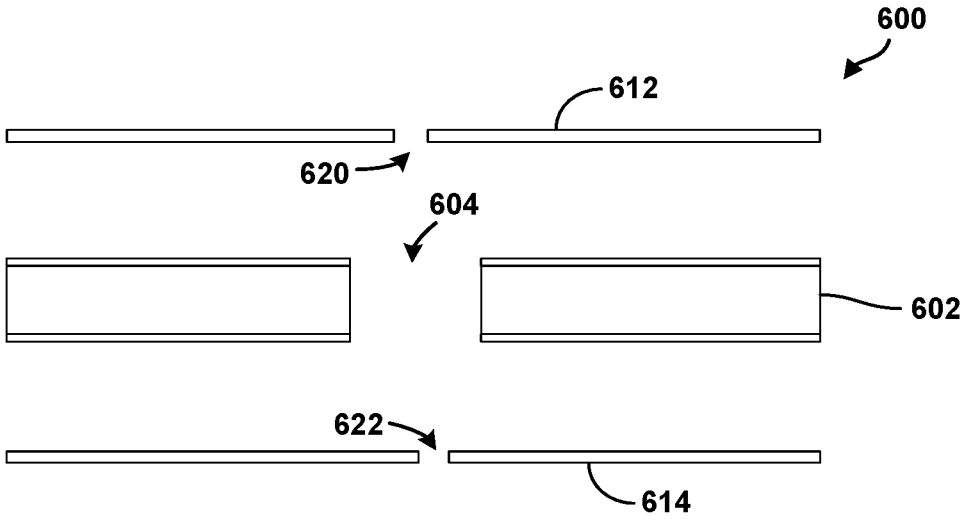
FIG. 6 illustrates an exploded view of a portion of an example waveguide apparatus.

Moreover, aspects of the method of FIG. 5 may be described with reference to FIGS. 1-4 and FIG. 6, where FIG. 6 illustrates an exploded view of a portion of an example waveguide apparatus 600. In this example, waveguide apparatus 600 has a layered construction that includes a waveguide layer 602 between a top layer 612 and a bottom layer 614.

At block 500, the method includes propagating electromagnetic energy via a waveguide in a waveguide layer. Additionally, block 500 may also include receiving electromagnetic energy via a port in a bottom layer and coupling the electromagnetic energy from the port into the waveguide.

An example waveguide layer 602 is shown in FIG. 6 along with a portion of a waveguide 604 formed into the waveguide layer. FIG. 6 shows an example waveguide apparatus 600 in a cross-section view (i.e. the view of FIG. 6 is as if a vertical slice of an example waveguide apparatus 600 was viewed head on). Within examples, the one or more waveguide channels formed into the waveguide layer may be routing waveguide channels configured to direct electromagnetic waves (e.g., millimeter electromagnetic waves), after the waves enter the waveguide antenna, to various radiating slots, such as the Z-Slots described above. These and/or other waveguide channels formed into the waveguide layer may have various shapes and dimensions, such as the dimensions noted above with respect to the waveguide 102 of FIG. 1. By way of example, one or more portions of the waveguide channels may be approximately 2.54 mm by approximately 1.27 mm, in accordance with the internal dimensions described above, where the waveguide layer 602 is approximately 2.54 mm thick.

Furthermore, the bottom layer 614 may include an input port 622 configured to receive electromagnetic waves into the waveguide apparatus 600, which may then be propagated through waveguide 604 and be radiated out the radiating element 620. Although the input port 622 is illustrated to be directly below the radiating element 620, it should be understood that, in some embodiments, that the input port 622 may be located elsewhere in the bottom layer 614 with respect to the radiating element 620 and not located directly below the radiating element. Additionally, in some embodiments, input port 622 may actually function as an output port to allow electromagnetic energy to leave the waveguide 604.

Referring back to FIG. 5, at block 502, the method includes coupling the electromagnetic energy from the waveguide to a radiating element located in a radiating layer coupled to the waveguide layer. As electromagnetic energy propagates down a waveguide, a portion of the electromagnetic energy may couple into one or more of the radiating elements, such as the radiating Z-Slots (204*a*-204*j*) described with respect to FIG. 2. In some instances, each of the radiating elements may have an associated impedance. As previously described, the impedance for each respective radiating element may be a function of the both the dimensions of the respective slot and the rotation of the respective slot. The impedance of each respective radiating element may determine a coupling coefficient between each respective radiating element and the waveguide. The coupling coefficient is a measure of a percentage of the electromagnetic energy propagating down the waveguide that is radiated by the respective radiating element.

At block 504, the method includes radiating the coupled electromagnetic energy with the radiating element. By way of example, as shown in FIG. 6, the top layer 612 may include at least one radiating element 620. The radiating element 620 may be etched, cut, or otherwise located on sheet of metal that is adhered to the waveguide layer 602. The radiating element 620 may be configured to radiate electromagnetic energy coupled from inside the waveguide 604 out into free space (i.e., the radiating element converts the guided energy in the waveguide 604 into unguided energy propagating in free space).

In some embodiments, method 500 may be performed in the reverse order (i.e. electromagnetic energy may be received by the waveguide apparatus 600). The radiating element 620 may be configured to receive electromagnetic energy propagating in free space and route the received energy into the waveguide 604 (i.e., the radiating structure converts the unguided energy from free space into guided energy propagating in a waveguide). The energy inside waveguide 604 may propagate through the waveguide 604 to the port 622 (which would be an output port, in this example).

Figure 7:
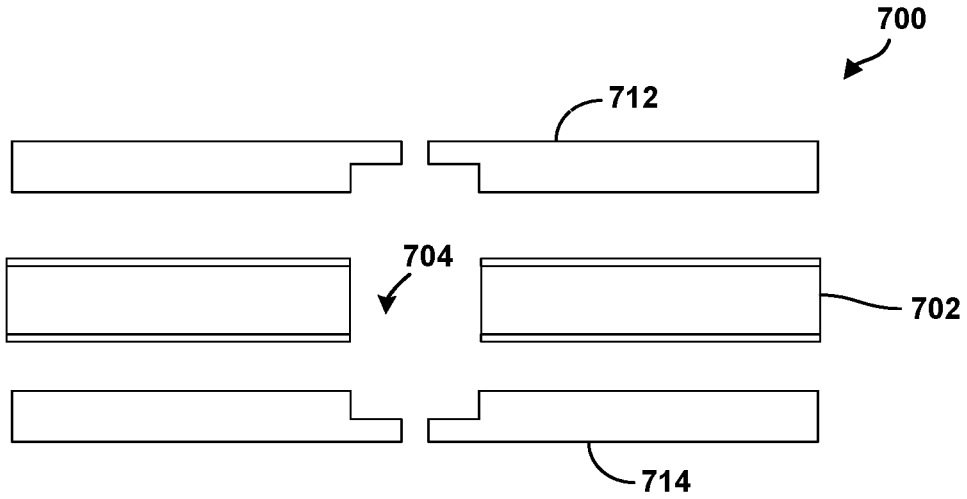
FIG. 7 illustrates an exploded view of a portion of another example waveguide apparatus.

In some embodiments, as shown in FIG. 7, at least a portion of the one or more waveguide channels 704 may be formed into at least one of the radiating 712 and bottom 714 metal layers. For instance, a first portion of the one or more waveguide channels may be formed into the radiating metal layer 712, whereas a second portion and third portion of the one or more waveguide channels 704 may be formed into the waveguide 702 and bottom 714 metal layers, respectively, where the second and third portions may or may not be identical. In such embodiments, when the radiating 712, waveguide 702, and bottom 714 layers are coupled together, the layers may be coupled together such that the portions of the one or more waveguide channels 704 of the second and/or third layers are substantially aligned with the first portion of the one or more waveguide channels of the first metal layer, thus forming one or more waveguide channels in the waveguide antenna that may be configured to propagate electromagnetic waves (e.g., millimeter electromagnetic waves). In this example, a width of the waveguide 704 may be wider than the width of the waveguide layer 702, as a portion of the waveguide may also be located in the radiating layer 712 and/or the bottom layer 714.

In other embodiments, the one or more waveguide channels may be formed entirely in the waveguide metal layer. In such other embodiments, the radiating and bottom metal layers may include other elements that may be configured to facilitate radiation of electromagnetic waves. For instance, as shown in FIG. 6, the radiating metal layer may include a radiating element 620, such as a radiating element that comprises a slot configured to radiate electromagnetic waves out of the waveguide apparatus 600, such as millimeter electromagnetic waves. The slot may have a rotational orientation relative to a dimension of the one or more waveguide channels. For example, the slot may be a Z-Slot or another type of slot.

It should be understood that various processes, including but not limited to those described above, may be involved with the radiating, waveguide, bottom, and/or additional layers. It should also be understood that arrangements described herein are for purposes of example only. As such, those skilled in the art will appreciate that other arrangements and other elements (e.g. machines, apparatuses, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. A radiating structure comprising:

a waveguide channel configured to propagate electromagnetic energy, wherein the waveguide channel has a height dimension and a width dimension, wherein the width dimension is greater than the height dimension, and wherein a first portion of the waveguide channel is located in a waveguide layer;

a radiating layer coupled to the waveguide layer, wherein:

the radiating layer is parallel to the height dimension of the waveguide channel;

the radiating layer comprises a second portion of the waveguide channel;

the radiating layer comprises a plurality of radiating slots, wherein each radiating slot:

is defined by an angular or curved path, is coupled to the waveguide channel at a location along the height dimension of the waveguide channel, and has an effective length greater than the height dimension of the waveguide channel, wherein the effective length is measured along the angular or curved path of the slot.

2. The radiating structure according to claim 1, wherein the slot is defined by an angular path having a 7-shape.

3. The radiating structure according to claim 1, wherein the slot is defined by an angular path having a Z-shape, wherein the Z-shape includes a center portion and two arms, wherein each arm is connected to the center portion at opposing ends of the center portion.

4. The radiating structure according to claim 1, wherein the slot is defined by a curved path having an S-shape.

5. The radiating structure of claim 1, wherein the waveguide antenna is configured to operate at approximately 77 Gigahertz (GHz) and propagate millimeter (mm) electromagnetic waves.

6. The radiating structure of claim 1, wherein each radiating element has a respective rotation and the respective rotation of each radiating element is selected based on a desired coupling coefficient.

7. The radiating structure of claim 1, wherein each radiating element has the same effective length as the other radiating elements.

8. A method of radiating electromagnetic energy comprising:

propagating electromagnetic energy via a waveguide channel, wherein the waveguide channel has a height dimension and a width dimension, wherein the width dimension is greater than the height dimension, and wherein a first portion of the waveguide channel is located in a waveguide layer and a section portion of the waveguide channel is located in a radiating layer;

coupling the electromagnetic energy from the waveguide channel to a plurality of radiating slots located in the radiating layer coupled to the waveguide layer, wherein:

the radiating layer is parallel to the height dimension of the waveguide channel;

the radiating layer comprises the plurality of radiating slots, wherein each radiating slot:

is defined by an angular or curved path, is coupled to the waveguide channel at a location along the height dimension of the waveguide, and has an effective length greater than the height dimension of the waveguide channel, wherein the effective length is measured along the angular or curved path of the slot; and radiating the coupled electromagnetic energy with the radiating element.

9. The method according to claim 8, wherein the slot is defined by a curved path having a 7-shape.

10. The method according to claim 8, wherein the slot is defined by an angular path having a Z-shape, wherein the Z-shape includes a center portion and two arms, wherein each arm is connected to the center portion at opposing ends of the center portion.

11. The method according to claim 8, wherein the slot is defined by a curved path having an S-shape.

12. The method of claim 8, wherein the waveguide antenna is configured to operate at approximately 77 Gigahertz (GHz) and propagate millimeter (mm) electromagnetic waves.

13. The method of claim 8, wherein each radiating element has a respective rotation and the respective rotation of each radiating element is selected based on a desired coupling coefficient.

14. The method of claim 8, wherein each radiating element has the same effective length as the other radiating elements.

15. A radiating structure comprising:

a waveguide channel configured to propagate electromagnetic energy, wherein the waveguide channel has a height dimension and a width dimension, wherein the width dimension is greater than the height dimension, wherein the electromagnetic energy has a wavelength, and wherein a first portion of the waveguide channel is located in a waveguide layer;

a radiating layer coupled to the waveguide layer, wherein:

the radiating layer is parallel to the height dimension of the waveguide;

the radiating layer comprises a second portion of the waveguide;

the radiating layer comprises a linear array of radiating elements, wherein the array comprises:

a plurality of radiating elements, wherein each radiating element:

comprises a slot defined by an angular or curved path, is coupled to the waveguide channel at a location along the height dimension of the waveguide, and has an effective length greater than the height dimension of the waveguide, wherein the effective length is measured as the entire path length along the angular or curved path of the radiating element; and a spacing between adjacent radiating elements in the linear array is approximately equal to half the wavelength.

16. The radiating structure of claim 15, wherein the radiating element is defined by an angular path having a Z-shape, wherein the Z-shape includes a center portion and two arms, wherein each arm is connected to the center portion at opposing ends of the center portion.

17. The radiating structure of claim 15, wherein each radiating element has a respective rotation and the respective rotation of each radiating element is selected based on a desired coupling coefficient.

18. The radiating structure of claim 15, wherein each radiating element has the same effective length as the other radiating elements.

19. The radiating structure of claim 15, wherein each radiating element is defined by a curved path having an S-shape.

20. The radiating structure of claim 15, wherein each radiating element is defined by a curved path having a 7-shape.

21. The radiating structure according to claim 1, further comprising an input layer having:

at least one port; and a third portion of the waveguide channel.

22. The radiating structure according to claim 15, further comprising an input layer having:

at least one port; and a third portion of the waveguide channel.

* * * * *